US007840025B2

(12) United States Patent
Ikeda et al.

(10) Patent No.: US 7,840,025 B2
(45) Date of Patent: Nov. 23, 2010

(54) LOUDSPEAKER DAMPER AND METHOD OF MOUNTING LOUDSPEAKER DAMPER

(75) Inventors: Emiko Ikeda, Tokyo (JP); Takahisa Tagami, Kanagawa (JP)

(73) Assignee: Sony Corporation, Tokyo (JP)

( * ) Notice: Subject to any disclaimer, the term of this patent is extended or adjusted under 35 U.S.C. 154(b) by 1156 days.

(21) Appl. No.: 11/491,293

(22) Filed: Jul. 24, 2006

(65) Prior Publication Data

US 2007/0025585 A1 Feb. 1, 2007

(30) Foreign Application Priority Data

Jul. 28, 2005 (JP) ..... 2005-219330

(51) Int. Cl.
*H04R 25/00* (2006.01)

(52) U.S. Cl. ..... 381/404; 381/403; 381/405

(58) Field of Classification Search ..... 381/396, 381/400, 403, 404, 405, 407, 409, 398; 29/594, 29/609.1; 181/171, 172
See application file for complete search history.

(56) References Cited

U.S. PATENT DOCUMENTS 2,147,605 A 2/1939 Lissauer
4,239,943 A * 12/1980 Czerwinski ..... 381/404
4,379,952 A * 4/1983 Kaizer et al. ..... 381/404
7,006,652 B2 * 2/2006 Tomiyama et al. ..... 381/404

FOREIGN PATENT DOCUMENTS

| | | |
|---|---|---|
| DE | 102 07 561 C1 | 7/2003 |
| EP | 0 720 415 A2 | 7/1996 |
| JP | 33-512 | 1/1958 |
| JP | 53-15308 | 4/1978 |
| JP | 54-98233 | 8/1979 |
| JP | 54-29783 | 9/1979 |
| JP | 55-6293 | 2/1980 |
| JP | 8-51695 | 2/1996 |
| JP | 11-146488 | 5/1999 |
| JP | 2000-59888 | 2/2000 |
| JP | 2003-47089 | 2/2003 |
| JP | 3506855 | 12/2003 |
| JP | 2004-112276 | 4/2004 |

* cited by examiner

*Primary Examiner*—Huyen D Le
(74) *Attorney, Agent, or Firm*—Oblon, Spivak, McClelland, Maier & Neustadt, L.L.P.

(57) ABSTRACT

A loudspeaker damper including: an outer damper; and an inner damper; wherein the outer damper and the inner damper configured to damp a vibrating portion relative to a fixed portion of a loudspeaker, wherein the outer damper supports the outer periphery of a voice coil of the vibrating portion, and supports the outer periphery of the voice coil relative to the fixed portion, wherein the inner damper supports the inner periphery of the voice coil, and supports the inner periphery of the voice coil relative to the fixed portion.

8 Claims, 11 Drawing Sheets

LOUDSPEAKER DAMPER AND METHOD OF MOUNTING LOUDSPEAKER DAMPER

CROSS REFERENCES TO RELATED APPLICATIONS

The present invention contains subject matter related to Japanese Patent Application JP 2005-219330 filed in the Japanese Patent Office on Jul. 28, 2005, the entire contents of which being incorporated herein by reference.

BACKGROUND OF THE INVENTION

1. Field of the Invention

The present invention relates to a loudspeaker damper, used for a loudspeaker or the like, and a method of mounting the loudspeaker damper.

2. Description of the Related Art

A damper playing the role of damping a voice coil of a vibrating portion so as to properly holding the voice coil in a magnetic pole space between a pole and a plate has been used for a loudspeaker in related art. FIGS. 15A to 15C are diagrams showing the shapes of dampers according to the related art, in which FIG. 15A shows a track-shaped damper, FIG. 15B shows an inner damper, and FIG. 15C shows a butterfly damper.

In the case of reducing the width of a diaphragm of a loudspeaker, a method may be used in which, as shown in FIG. 15A, a track-shaped damper 151 is used in the state of surrounding the outer periphery of a track-shaped voice coil 152 having a minor diameter and a major diameter. According to the method in which the track-shaped damper 151 is used, the width of the diaphragm can be reduced to a width roughly equivalent to the minor diameter of the track-shaped damper 151.

Besides, as shown in FIG. 15B, there may be adopted a method in which a damper 153 is used on the inside of a track-shaped voice coil 154 having a minor diameter and a major diameter, or a method in which a damper 155 is used on the inside of a circular voice coil 156. According to the method in which the damper 153 is used on the inside of the track-shaped voice coil 154, the width of the diaphragm can be reduced to a width roughly equivalent to the minor diameter of the track-shaped voice coil 154 or the diameter of the circular voice coil 156.

Further, as shown in FIG. 15C, a method has been proposed in which use is made of a butterfly damper 157 having a frame portion 158 for supporting the outer periphery of a voice coil 161, and a pair of support portions 159 and 160 for supporting the frame portion 158 from both sides in the major diameter direction. According to the method in which the butterfly damper 157 is used, there is no support in the minor diameter direction, so that the minimum resonance frequency $F_0$ of the diaphragm of the loudspeaker is not raised, and the width of the diaphragm can be reduced. Furthermore, there have been proposed a method in which the damper is eliminated and a method in which the damper is simplified. According to these methods, also, a sufficiently low minimum resonance frequency $F_0$ can be obtained, like in the case of using the butterfly damper.

In addition, in order to realize a sound wave radiation such that the frequency response is flat and the harmonic distortion is little over the range from a low frequency region to a high frequency region, an electroacoustic transducer has been proposed in which a hook type suspension having one end fixed in the longitudinal direction of a voice coil and the other end fixed to a frame supporting a magnetic circuit is provided at each of both ends of the voice coil (Japanese Patent Laid-open No. 2003-47089).

Besides, a loudspeaker damper has been proposed in which a voice coil has a major axis direction and a minor axis direction, a plurality of movable arms are formed along the major axis direction, a reinforcement member bridgingly provided between two movable arms of the plurality of movable arms is disposed substantially in parallel to the minor axis direction, in the vicinity of the voice coil support portion side (Japanese Patent No. 3506855).

SUMMARY OF THE INVENTION

However, in the case of the method in which the track-shaped damper 151 shown in FIG. 15A is used, the length of the damper 151 in the minor diameter direction is small, so that the stiffness indicating the hardness of the diaphragm material of a cone edge, the damper or the like would be high. As a result, the minimum resonance frequency $F_0$ which is the lower limit of the reproduction band would be raised. Therefore, in order to design a loudspeaker having a sufficiently low minimum resonance frequency $F_0$, it is necessary to enlarge the width of the damper in the minor diameter direction, with the result that the width of the loudspeaker would be large.

Besides, according to the method in which the damper 153 is used on the inside of the voice coil 154 as shown in FIG. 15B, the width of the damper 153 is no more than one half of the inside diameter of the voice coil 154, so that the minimum resonance frequency $F_0$ would be raised.

Furthermore, according to the method in which the butterfly damper 157 shown in FIG. 15C is used, the support exists only in the major diameter direction, and support in the minor diameter direction is absent. As a result, the voice coil 161 undergoes rolling in the minor diameter direction at the time of vibration in response to the input of a signal at a high level.

In addition, the damper plays the role of mechanically supporting the vibrating portion such as the diaphragm and the voice coil. According to the method in which the damper is eliminated or simplified, therefore, the lacking of the damper leads to a lowering in input resistance indicative of the response of vibration to an input signal, and, accordingly, the voice coil would undergo rolling upon input of a high-level signal.

Besides, in the technology described in Japanese Patent Laid-open No. 2003-47089, the voice coil is supported only in the longitudinal direction by the hook type suspensions, and there is no support in the transverse direction. Therefore, the voice coil would undergo rolling in the transverse direction.

In addition, in the technology described in Japanese Patent No. 3506855, the damper is supported by the plurality of movable arms in the major axis, but, in the minor axis direction, there is only the reinforcement member bridgingly disposed between two movable arms in parallel to the minor axis direction. Therefore, it is only possible to reinforce the two movable arms by the reinforcement member, and there is no support in the minor axis direction, so that the voice coil would undergo rolling in the minor axis direction.

It is desirable to provide a loudspeaker damper and a method of mounting the loudspeaker damper which make it possible to design a loudspeaker having a sufficiently low minimum resonance frequency $F_0$, to disperse the support in a major axis direction and the support in a minor axis direction, and to prevent a voice coil from rolling in the minor axis direction at the time of vibration in response to a high input.

According to an embodiment of the present invention, there is provided a loudspeaker damper including: an outer damper for supporting the outer periphery of a voice coil of a vibrating portion and supporting the outer periphery of the voice coil relative to a fixed portion; and an inner damper for supporting the inner periphery of the voice coil and supporting the inner periphery of the voice coil relative to the fixed portion.

With this loudspeaker damper, the voice coil is supported in the major diameter direction by the outer damper on the outside thereof and in the minor diameter direction by the inner damper on the inside thereof, so that a vibrating portion can be supported firmly, and rolling of the voice coil or the like can be prevented from occurring even upon input of a high-level signal. Therefore, it is possible to provide a loudspeaker which is high in input resistance and also can reproduce a sound with little distortion even upon input of a high-level signal. In addition, according to an embodiment of the present invention, the minimum resonance frequency $F_0$ as the lower limit of the reproduction frequency of the loudspeaker would not be raised, so that sounds in sufficiently low frequency regions can also be reproduced with the small-width loudspeaker. This makes it possible to provide a loudspeaker which is high in input resistance, has a wide reproduction band, and is small in size in the width direction.

According to another embodiment of the present invention, there is provided a method of mounting a loudspeaker damper, including the steps of: mounting an outer damper, by adhering the outer periphery of a voice coil and a frame portion for supporting the outer periphery of the voice coil, and by adhering a frame of a fixed portion and a pair of support portions for supporting the major diameter of the frame portion from both sides, through a mounting portion; and mounting an inner damper, by adhering the inner periphery of the voice coil and a frame portion for supporting the inner periphery of the voice coil, and by adhering a pole of the fixed portion and a pair of support portions for supporting the minor diameter of the frame portion from both sides, through a mounting portion; at a position where the outer damper and the inner damper are fixed by use of a jig which is fitted in the inner periphery of the voice coil having a track-like shape having a minor diameter and a major diameter of the vibrating portion and which is fitted over the outer periphery of the pole of the fixed portion.

According to this mounting method, the adhesion of the support portion in the major diameter direction of the outer damper on the outside of the voice coil and the adhesion of the support portion in the minor diameter direction of the inner damper on the inside of the voice coil are performed at the position fixed by use of the jig, whereby the vibrating portion can be supported firmly, and the voice coil can be prevented from undergoing rolling or the like even upon input of a high-level signal. Therefore, it is possible to provide a loudspeaker which is high in input resistance and also can reproduce sounds with little distortions even upon input of a high-level signal. In addition, when the damper according to the present invention is used, the minimum resonance frequency $F_0$ as the lower limit of the reproduction frequency of the loudspeaker would not be raised, so that sounds in sufficiently low frequency regions can also be reproduced with a small-width loudspeaker. Accordingly, it is possible to produce a loudspeaker which is high in input resistance, has a wide reproduction band, and is small in size in the width direction.

According to yet another embodiment of the present invention, the voice coil is supported in the major diameter direction by the outer damper on the outside thereof and in the minor diameter direction by the inner damper on the inside thereof, whereby the vibrating portion can be supported firmly, and rolling and the like can be prevented from occurring even upon input of a high-level signal. Therefore, a high input resistance is ensured, and sounds with little distortion can be reproduced even upon input of a high-level signal. Besides, according to the damper of the present invention, the minimum resonance frequency $F_0$ as the lower limit of the reproduction frequency of the loudspeaker would not be raised, so that sounds in sufficiently low frequency regions can be reproduced with a small-width loudspeaker.

The above and other features and advantages of the present invention will become apparent from the following description when taken in conjunction with the accompanying drawings which illustrate preferred embodiments of the present invention by way of example.

BRIEF DESCRIPTION OF THE DRAWINGS

FIGS. 4A to 4C show an example of a fabric damper, in which FIG. 4A is a front view, FIG. 4B is an X-X sectional view, and FIG. 4C is a Y-Y sectional view;

FIGS. 5A to 5C show an example of a butterfly damper, in which FIG. 5A is a front view, FIG. 5B is an X-X sectional view, and FIG. 5C is a Y-Y sectional view;

FIGS. 12A and 12B show insertion holes of a pole, in which FIG. 12A is a bottom view, and FIG. 12B is a partly sectional view;

FIGS. 15A to 15C show the shapes of dampers in related art, in which FIG. 15A shows a track-shaped damper, FIG. 15B shows an inner damper, and FIG. 15C shows a butterfly damper.

DETAILED DESCRIPTION OF THE PREFERRED EMBODIMENTS

Figure 1:
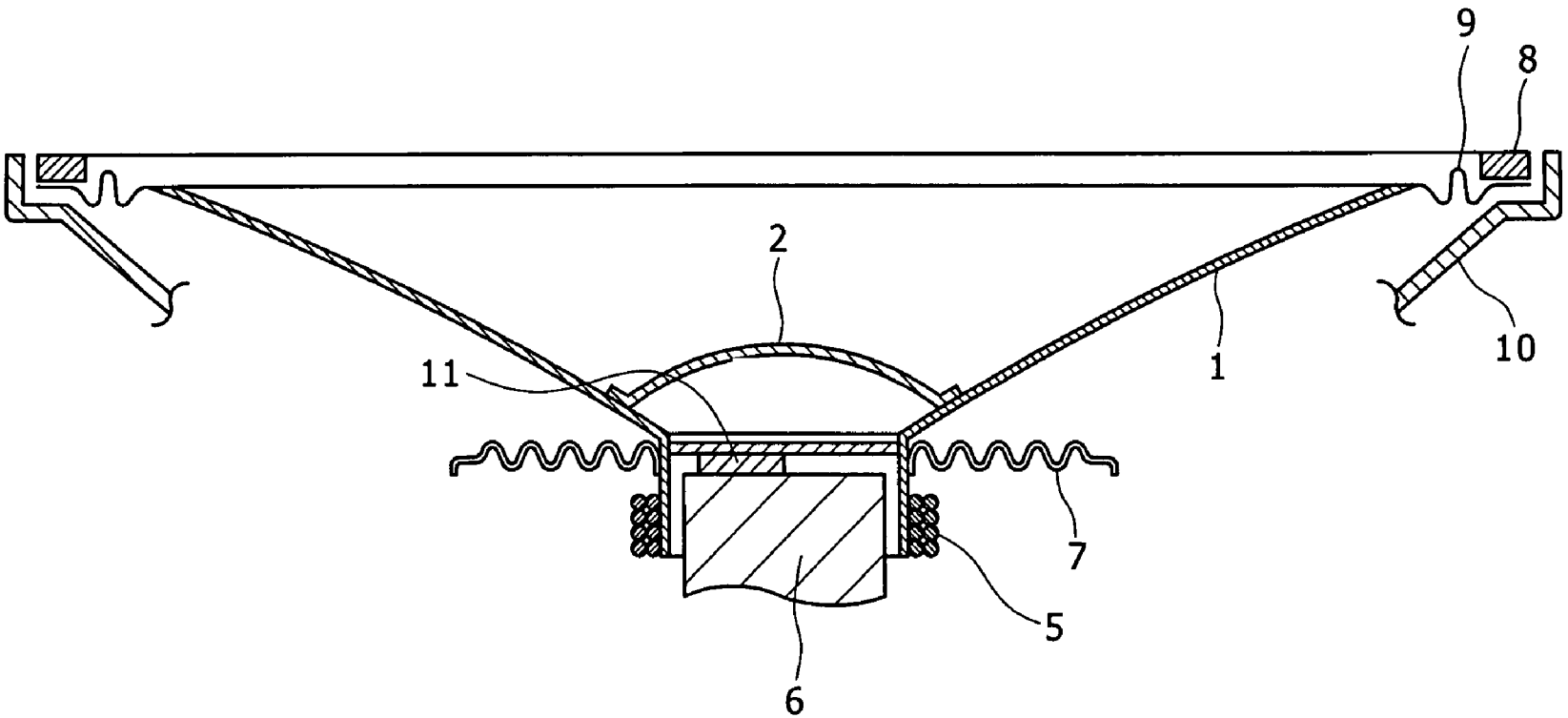
FIG. 1 is an illustration of a vibrating portion of a loudspeaker.

Now, some embodiments of the present invention will be described in detail below, referring to the drawings.

FIG. 1 is an illustration of a loudspeaker vibrating portion. A loudspeaker unit is configured to include the loudspeaker vibrating portion as shown in FIG. 1.

A center cap 2 is provided for preventing a cone 1 from being deformed in the radial direction, and for preventing iron powder and dust from entering into a gap.

An outer damper 7 supports the outer periphery of a voice coil 5 in the major diameter direction by one end of a support portion, and the other end of the support portion is attached to a fixed portion such as a frame 10. In addition, an inner damper 11 supports the inner periphery of the voice coil 5 by a support portion in a minor diameter direction, and the support portion is attached to a fixed portion such as a pole 6, whereby the voice coil 5 is held properly around the pole 6. A gasket 8 is for fixing the edge 9 of the cone 1 to the frame 10.

Figure 2A:
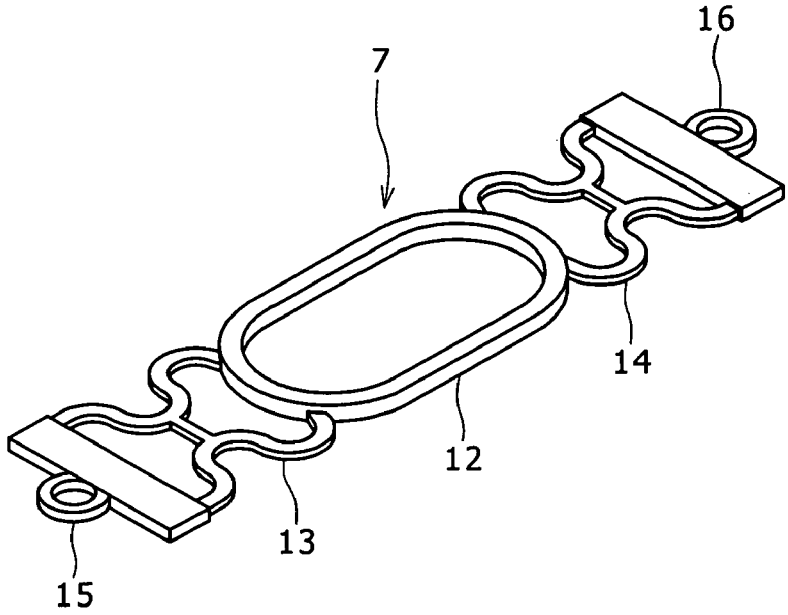
FIGS. 2A, 2B and 2C are perspective views of an outer damper, an inner damper and a voice coil, respectively.
Figure 2B:
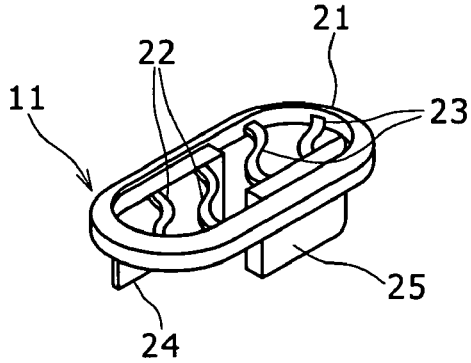
Figure 2C:
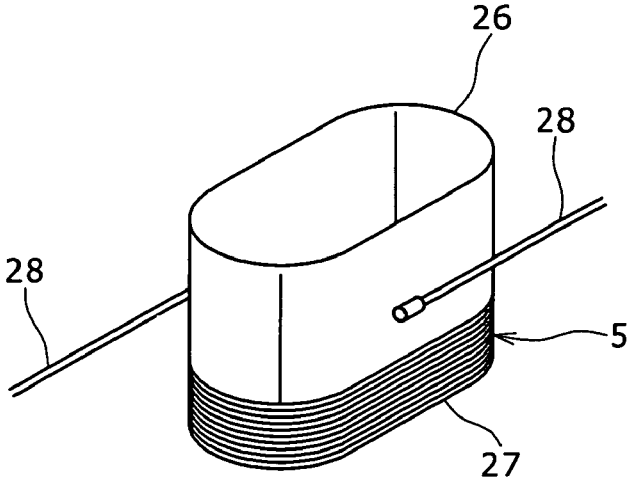

FIGS. 2A, 2B and 2C are perspective views of the outer damper, the inner damper and the voice coil, respectively.

In FIG. 2A, the outer damper 7 includes a frame portion 12 for supporting the outer periphery of the voice coil 5, a pair of support portions 13 and 14 for supporting the major diameter of the frame portion 12 from both sides, and mounting portions 15 and 16 for mounting both the support portions 13 and 14 onto the frame 10 of the fixed portion.

In FIG. 2B, the inner damper 11 includes a frame portion 21 for supporting the inner periphery of the voice coil 5, a pair of support portions 22 and 23 for supporting the minor diameter of the frame portion 21 from both sides, and mounting portions 24 and 25 for mounting both the support portions 22 and 23 onto the pole 6 of the fixed portion.

In FIG. 2C, the voice coil 5 is configured to have a track-like shape having a minor diameter and a major diameter, and includes a bobbin portion 26 as a coil bobbin, a coil portion 27 wound around the bobbin portion 26, and lead wires 28 led out from the coil portion 27.

Figure 3:
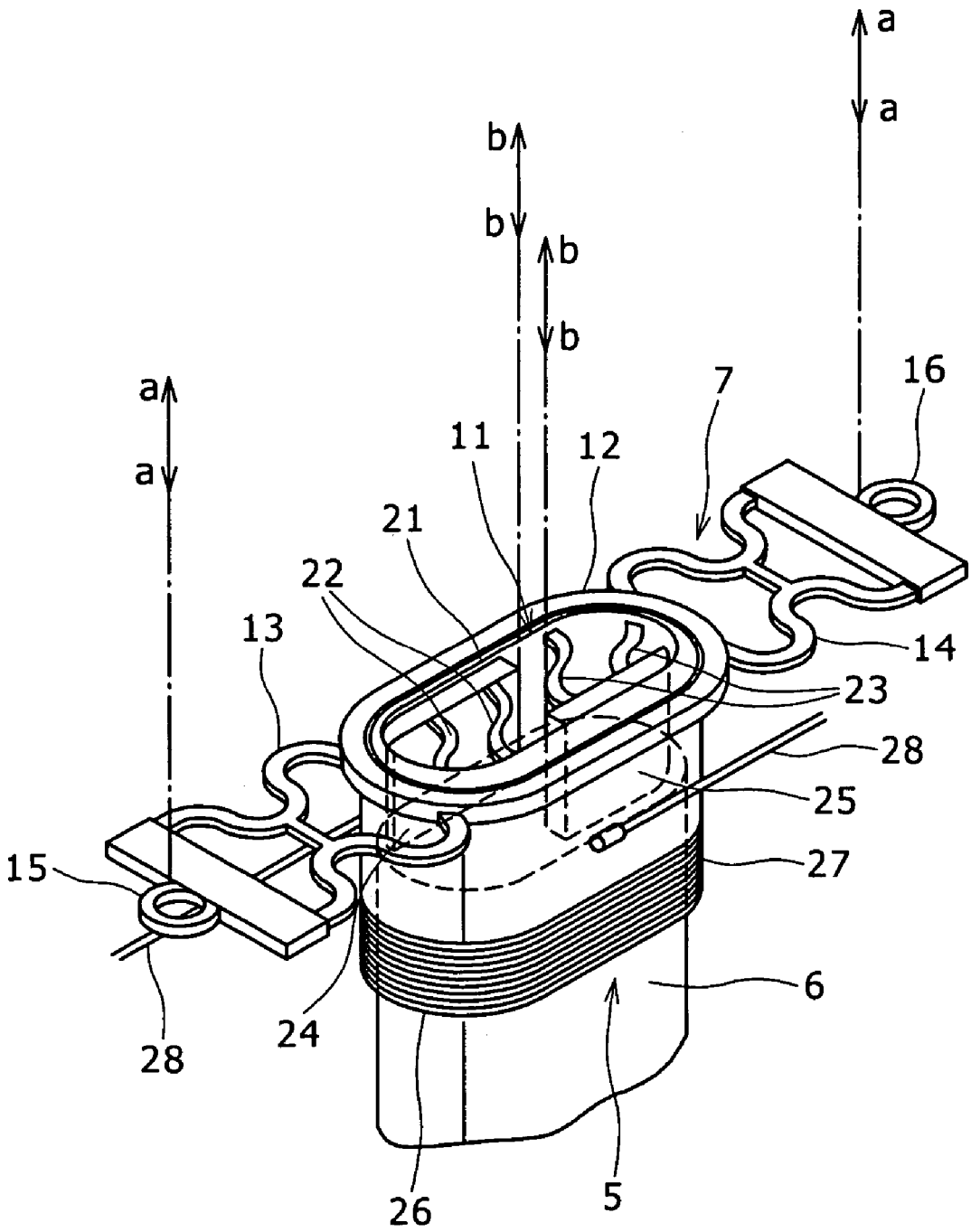
FIG. 3 is a perspective view showing the condition where the outer damper and the inner damper are mounted onto the voice coil.

FIG. 3 is a perspective view showing the condition where the outer damper and the inner damper are mounted onto the voice coil.

In FIG. 3, the outer damper 7 supports the outer periphery of the track-shaped voice coil 5 having the minor diameter and the major diameter in the condition where the outer periphery of the voice coil 5 of the vibrating portion is fitted in the frame portion 12 of the outer damper 7. In addition, the major diameter of the frame portion 12 is supported from both sides by the pairs of support portions 13 and 14. Further, the mounting portions 15 and 16 provided at both ends of the support portions 13 and 14 mount fixingly both the support portions 13 and 14 onto the frame 10 of the fixed portion.

The inner damper 11 supports the inner periphery of the track-shaped voice coil 5 having the minor diameter and the major diameter in the condition where the inner periphery of the voice coil 5 is fitted over the frame portion 21 of the inner damper 11. In addition, the minor diameter of the frame portion 21 is supported alternately from both sides by the pairs of support portions 22 and 23. Further, the mounting portions 24 and 25 provided in L shape at both ends of the support portions 22 and 23 mount alternately fixingly both the support portions 22 and 23 onto the upper surface of the pole 6 of the fixed portion disposed on the inside of the voice coil 5.

The voice coil 5 configured in the track-like shape having the minor diameter and the major diameter is respectively sharedly supported in the major diameter direction indicated by a-a by the outer damper 7 on the outside thereof and in the minor diameter direction indicated by b-b by the inner damper 11 on the inside thereof. As a result, the vibrating portion is damped so as to be properly held in a magnetic pole space between the pole 6 and a plate (not shown), whereby the vibrating portion is supported securely, and the voice coil 5 can be prevented from undergoing rolling or the like in the minor diameter direction indicated by b-b even upon input of a high-level signal.

Figure 4A:
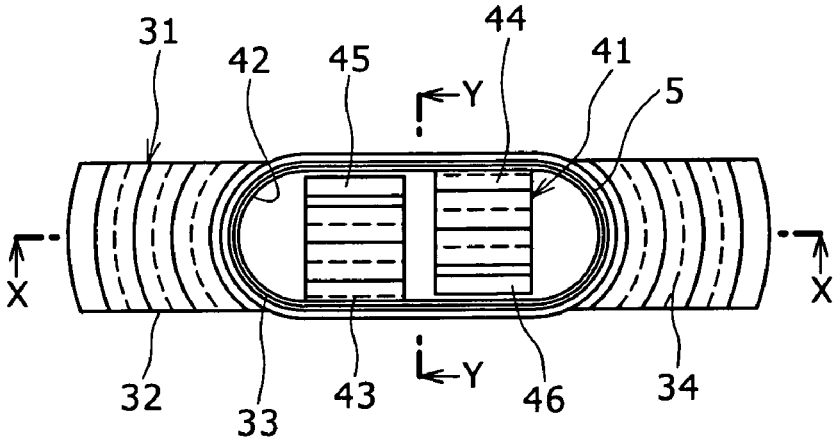
Figure 4B:
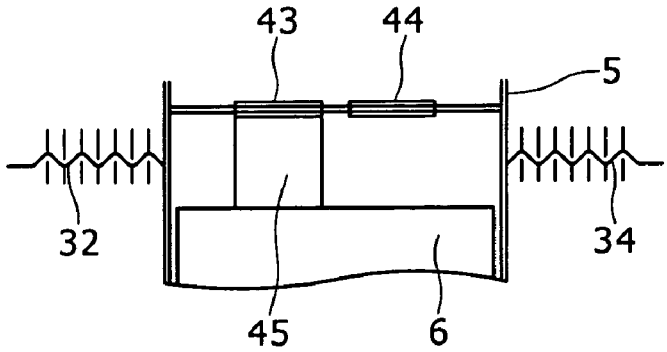
Figure 4C:
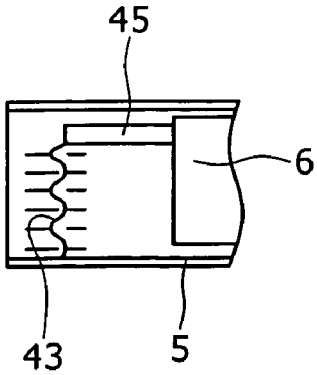

FIGS. 4A to 4C show an example of a fabric damper, in which FIG. 4A is a front view, FIG. 4B is an X-X sectional view, and FIG. 4C is a Y-Y sectional view.

In FIGS. 4A and 4B, an outer damper 31 supports the outer periphery of a track-shaped voice coil 5 having a minor diameter and a major diameter in the condition where the outer periphery of the voice coil 5 of the vibrating portion is fitted in a frame portion 33 of the outer damper 31. In addition, the major diameter of the frame portion 33 is supported from both sides by a pair of support portions 32 and 34 each composed of a fabric folded in a corrugated form. Further, mounting portions, not shown in the figure, provided at both ends of the pair of support portions 32 and 34 each composed of a fabric folded in a corrugated form mount fixingly both the support portions 32 and 34 onto a frame 10 of a fixed portion.

In FIGS. 4B and 4C, an inner damper 41 supports the inner periphery of the track-shaped voice coil 5 having the minor diameter and the major diameter in the condition where the inner periphery of the voice coil 5 is fitted over a frame portion 42 of the inner damper 41. Besides, the minor diameter of the frame portion 42 is supported alternately from both sides by a pair of support portions 43 and 44 each composed of a fabric folded in a corrugated form. Further, plate-like mounting portions 45 and 46 provided in L shape at both ends of the pair of support portions 43 and 44 each composed of a fabric folded in a corrugated form mount alternately fixingly both the support portions 43 and 44 onto the upper surface of a pole 6 of a fixed portion disposed on the inside of the voice coil 5.

The voice coil 5 configured to have the track-like shape having the minor diameter and the major diameter is supported respectively sharedly in the major diameter direction indicated by X-X by the fabric-made outer damper 31 folded in the corrugated form and provided on the outside of the voice coil 5, and in the minor diameter direction indicated by Y-Y by the fabric-made inner damper 41 folded in the corrugated form and provided on the inside of the voice coil 5. As a result, the vibrating portion is damped so as to be held properly in a magnetic pole space between the pole 6 and a plate, not shown in the figure, whereby the vibrating portion can be supported securely, and the voice coil 5 can be prevented from undergoing rolling or the like in the minor diameter direction indicated by Y-Y even upon input of a high-level signal.

Figure 5A:
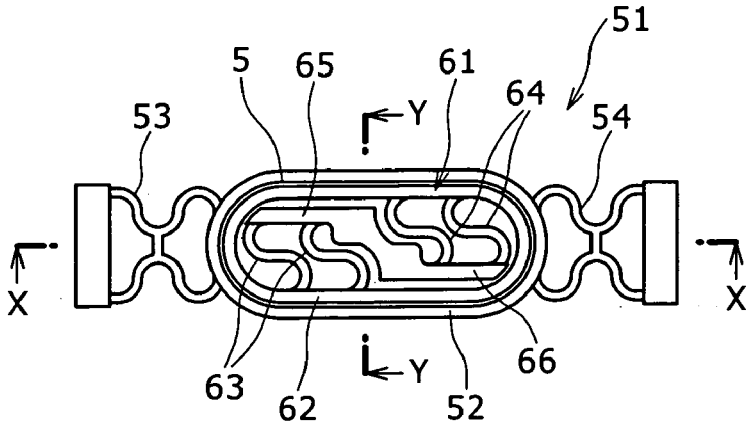
Figure 5B:
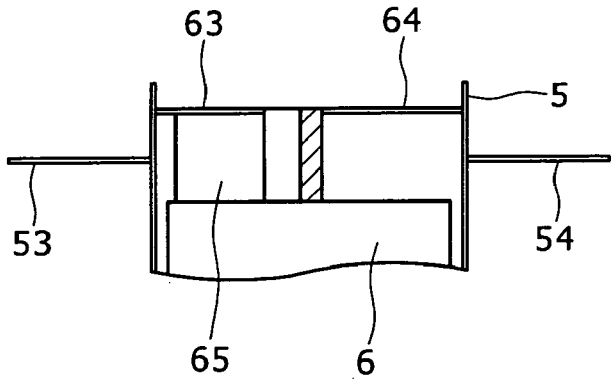
Figure 5C:
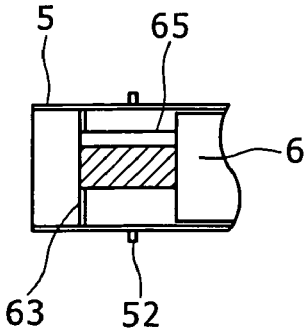

FIGS. 5A to 5C show an example of a butterfly damper, in which FIG. 5A is a front view, FIG. 5B is an X-X sectional view, and FIG. 5C is a Y-Y sectional view.

In FIGS. 5A and 5B, an outer damper 51 supports the outer periphery of a track-shaped voice coil 5 having a minor diameter and a major diameter in the condition where the outer periphery of the voice coil 5 of a vibrating portion is fitted in a frame portion 52 of the outer damper 51. In addition, the major diameter of the frame portion 52 is supported from both sides by a pair of support portions 53 and 54 each configured in a butterfly-like shape by combining plastic-made S-shaped members. Further, mounting portions, not shown in the figure, provided at both ends of the pair of support portions 53 and 54 each configured in the butterfly-like shape by combining the plastic-made S-shaped members mount fixingly both the support portions 53 and 54 onto a frame 10 of a fixed portion.

In FIGS. 5B and 5C, an inner damper 61 supports the inner periphery of a track-shaped voice coil 5 having a minor diameter and a major diameter in the condition where the inner periphery of the voice coil 5 is fitted over a frame portion 62 of the inner damper 61. In addition, the minor diameter of the frame portion 62 is supported alternately from both sides by a pair of support portions 63 and 64 each configured by combining plastic-made S-shaped members. Further, plate-like mounting portions 65 and 66 connected to each other in S shape and provided in L shape at both ends of the pair of support portions 63 and 64 each configured by combining the plastic-made S-shaped members mount alternately fixingly both the support portions 63 and 64 onto the upper surface of a pole 6 of a fixed portion disposed on the inside of the voice coil 5.

The voice coil 5 configured in the track-like shape having the minor diameter and the major diameter is supported respectively sharedly in the major diameter direction indicated by X-X by the butterfly-shaped outer damper 51 configured by combining the plastic-made S-shaped members and provided on the outside of the voice coil 5, and in the minor diameter direction indicated by Y-Y by the inner damper 61 configured by combining the plastic-made S-shaped members and provided on the inside of the voice coil 5. As a result, the vibrating portion is damped so as to be held properly in a magnetic pole space between the pole 6 and a plate, not shown in the figure, whereby the vibrating portion can be supported securely, and the voice coil 5 can be prevented from undergoing rolling or the like in the minor diameter direction indicated by Y-Y even upon input of a high-level signal.

Figure 6:
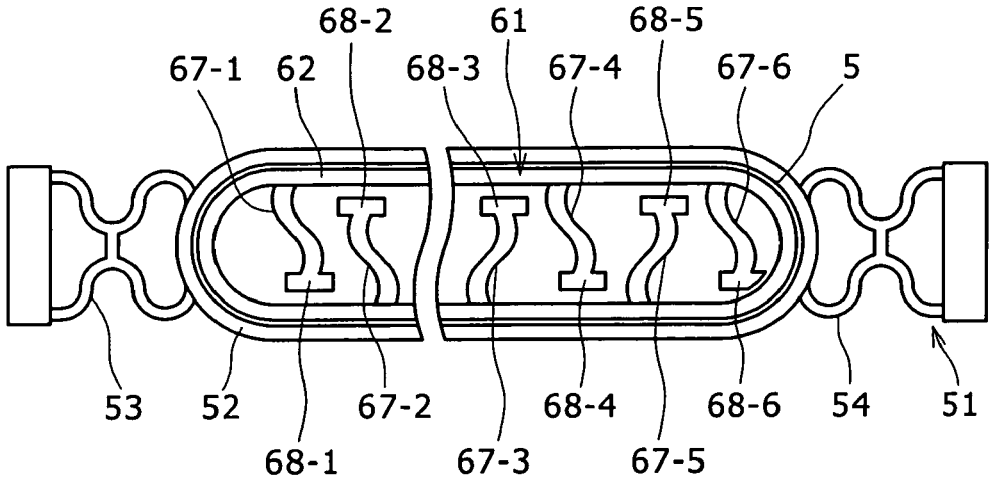
FIG. 6 shows an example in which an inner damper is provided with at least one pair of support portions and at least one pair of mounting portions.

FIG. 6 shows an example in which an inner damper is provided with at least one pair of support portions and at least one pair of mounting portions. While FIG. 6 shows an example in which three pairs of support portions and three pairs of mounting portions are provided, it shows that a plurality of pairs of support portions and a plurality of pairs of mounting portions can be provided according to the elongate shape of the loudspeaker.

In FIG. 6, an outer damper 51 supports the outer periphery of an elongate track-shaped voice coil 5 having a minor diameter and a major diameter in the condition where the outer periphery of the voice coil 5 of a vibrating portion is fitted in an elongate frame portion 52 of the outer damper 51. In addition, the major diameter of the frame portion 52 is supported from both sides by a pair of support portions 53 and 54 each configured in a butterfly-like shape by combining plastic-made S-shaped members. Further, mounting portions, not shown in the figure, provided at both ends of the pair of butterfly-shaped support portions 53 and 54 each configured by combining the plastic-made S-shaped members mount fixingly both the support portions 53 and 54 to a frame 10 of a fixed portion.

An inner damper 61 supports the inner periphery of the elongate track-shaped voice coil 5 having the minor diameter and the outer diameter in the condition where the inner periphery of the voice coil 5 is fitted over an elongate frame portion 62 of the inner damper 61. Besides, at a short portion on one side of the frame portion 62, the minor diameter of the frame portion 62 is supported alternately from both sides by a pair of plastic-made S-shaped support portions 67-1 and 67-2. Further, plate-like mounting portions 68-1 and 68-2 provided in L shape at both ends of the pair of plastic-made S-shaped support portions 67-1 and 67-2 mount alternately both the support portions 67-1 and 67-2 onto the upper surface of a pole 6 of a fixed portion disposed on the inside of the voice coil 5.

In addition, in the vicinity of the center of the frame portion 62, the minor diameter of the frame portion 62 is supported alternately from both sides by a pair of plastic-made S-shaped support portions 67-3 and 67-4. Further, plate-like mounting portions 68-3 and 68-4 provided in L shape at both ends of the pair of the plastic-made S-shaped support portions 67-3 and 67-4 mount alternately fixingly both the support portions 67-3 and 67-4 onto the upper surface of the pole 6 of the fixed portion disposed on the inside of the voice coil 5. Here, the pair of support portions 67-3, 67-4 and the pair of mounting portions 68-3, 68-4 provided in the vicinity of the center of the frame portion 62 may be provided in pluralities of pairs.

Besides, at a short portion on the other side of the frame portion 62, the minor diameter of the frame portion 62 is supported alternately from both sides by a pair of plastic-made S-shaped support portions 67-5 and 67-6. Further, plate-like mounting portions 68-5 and 68-6 provided in L shape at both ends of the pair of the plastic-made S-shaped support portions 67-5 and 67-6 mount alternately fixingly both the support portions 67-5 and 67-6 onto the upper surface of the pole 6 of the fixed portion disposed on the inside of the voice coil 5.

The voice coil 5 configured in the elongate track-like shape having the minor diameter and the major diameter is supported in the major diameter direction indicated by X-X (see FIG. 5A) by the elongate butterfly-shaped outer damper 51 configured by combining the plastic-made S-shaped members and provided on the outside of the voice coil 5, and in the minor diameter direction indicated by Y-Y (see FIG. 5A) by the elongate inner damper 61 configured by combining the plastic-made S-shaped members. Thus, the voice coil 5 is supported respectively shared by the outer damper 51 and the inner damper 61. As a result, the vibrating portion is damped so as to be held properly in a magnetic pole space between the pole 6 and a plate, not shown in the figure, and the vibrating portion is supported securely, so that the elongate voice coil 5 can be prevented from undergoing rolling or the like in the minor diameter direction indicated by Y-Y even upon input of a high-level signal.

While an example wherein the outer damper and the inner damper are configured as separate bodies has been described in the embodiments above, this configuration is not limitative, and a configuration may be adopted in which the outer damper and the inner damper are integral with each other.

Figure 7:
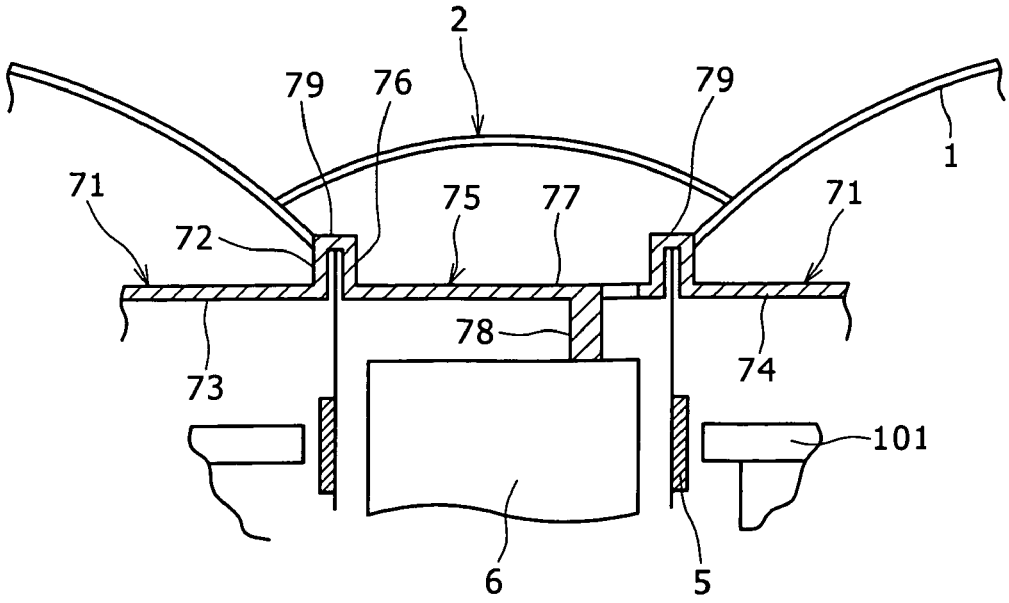
FIG. 7 shows an example in which an outer damper and an inner damper are integral with each other.

FIG. 7 shows an example in which an outer damper and an inner damper are integral with each other. FIG. 7 is different from the vibrating portion shown in FIG. 1, in that an outer damper 71 and an inner damper 75 are integrated with each other through a joint portion 79.

In this case, of a cone 1 constituting a diaphragm, that portion which may not be adhered directly to a voice coil 5 is adhered to the joint portion 79. The joint portion 79 is joining a frame portion 72 of the outer damper 71 and a frame portion 76 of the inner damper 75 to each other in an angular U shape. As a result, the joint portion 79 is so formed as to pinch an upper end portion of the voice coil 5, and a mounting portion 78 for mounting the inner damper 75 onto a pole 6 is fixedly mounted on the upper surface of the pole 6 disposed on the inside of the voice coil 5.

Figure 8:
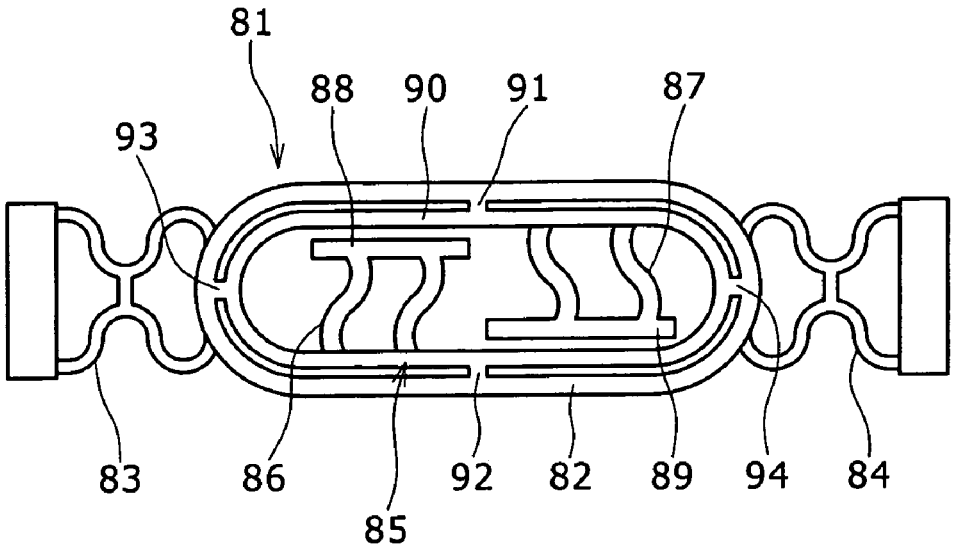
FIG. 8 shows a joined condition of an outer damper and an inner damper.

FIG. 8 shows a joined condition of an outer damper and an inner damper. FIG. 8 shows the condition where the inner damper shown in FIG. 6 is provided with one pair of support portions and one pair of mounting portions, and the outer damper and the inner damper are joined to each other through joint portions.

In FIG. 8, the outer damper 81 supports the outer periphery of a track-shaped voice coil 5 having a minor diameter and a major diameter in the condition where the outer periphery of the voice coil 5 of a vibrating portion is fitted in a frame portion 82 of the outer damper 81. Besides, the major diameter of the frame portion 82 is supported from both sides by a pair of butterfly-shaped support portions 83 and 84 each configured by combining plastic-made S-shaped members.

Further, mounting portions, not shown in the figure, provided at both ends of the pair of butterfly-shaped support portions 83 and 84 each configured by combining the plastic-made S-shaped members mount fixingly both the support portions 83 and 84 onto a frame 10 of a fixed portion.

Here, the frame portion 82 of the outer damper 81 and a frame portion 90 of the inner damper 85 are joined to each other, at their minor diameters through joint portions 91 and 92, and at their major diameters through joint portions 93 and 94. In this case, the joint portions 91 and 92 joining the minor diameters support the minor diameter of the track-shaped voice coil 5 by nipping upper end portions of the minor diameter of the voice coil 5, whereas the joint portions 93 and 94 joining the major diameters support the major diameter of the track-shaped voice coil 5 by nipping upper end portions of the major diameter of the voice coil 5.

The inner damper 85 supports the inner periphery of the track-shaped voice coil 5 having the minor diameter and the major diameter in the condition where the inner periphery of the voice coil 5 is fitted over the frame portion 90 of the inner damper 85. Besides, the minor diameter of the frame portion 90 is supported alternately from both sides by a pair of plastic-made S-shaped support portions 86 and 87. Further, plate-like mounting portions 88 and 89 provided in L shape at both ends of the pair of plastic-made S-shaped support portions 86 and 87 mount fixingly both the support portions 86 and 87 onto the upper surface of a pole 6 of a fixed portion disposed on the inside of the voice coil 5.

The voice coil 5 configured in the track-like shape having the minor diameter and the major diameter is supported sharedly, in the major diameter direction indicated by X-X by the plastic-made S-shaped butterfly type outer damper 51 provided on the outside of the voice coil 5, and in the minor diameter direction indicated by Y-Y by the plastic-made S-shaped inner damper 61 provided on the inside of the voice coil 5. Besides, in this case, the support in the minor diameter direction is shared by the joint portions 91 and 92 joining the minor diameters, and the support in the major diameter direction is shared by the joint portions 93 and 94 joining the major diameters.

As a result, the vibrating portion is damped so as to be held properly in a magnetic pole space between the pole 6 and a plate, not shown in the figure, and the vibrating portion is supported securely, so that the voice coil 5 can be prevented from undergoing rolling or the like in the minor diameter direction indicated by Y-Y even upon input of a high-level signal.

Now, a method of mounting the outer damper and the inner damper configured as above will be describe below, based on FIGS. 9 to 14.

Figure 9:
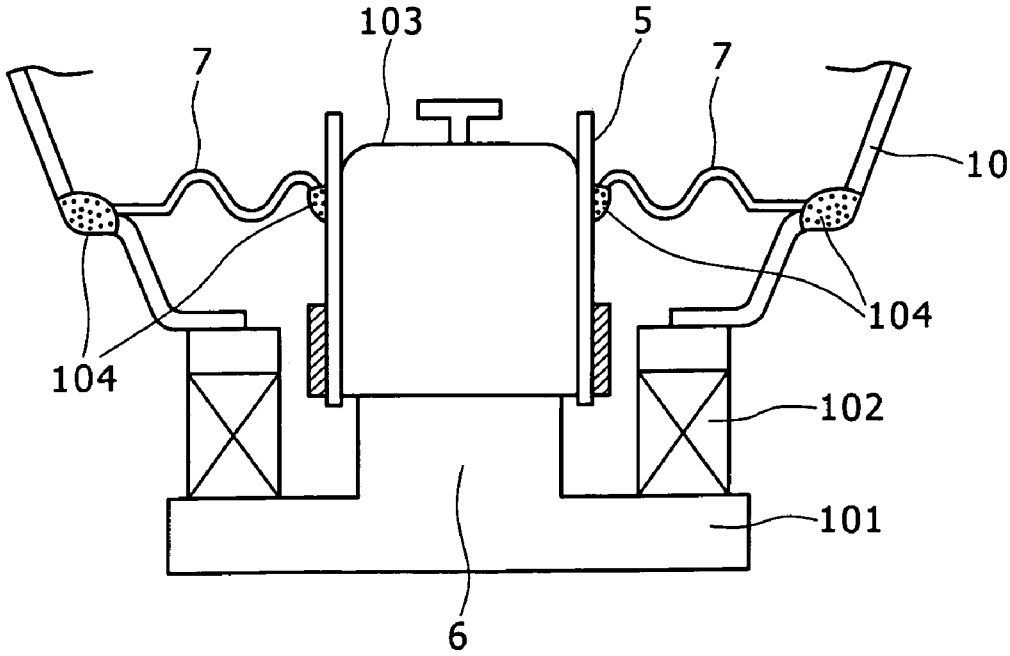
FIG. 9 shows a method of mounting an outer damper in the case where the outer damper and an inner damper are separate members.

FIG. 9 shows a method of mounting an outer damper in the case where the outer damper and an inner damper are separate bodies.

Figure 10:
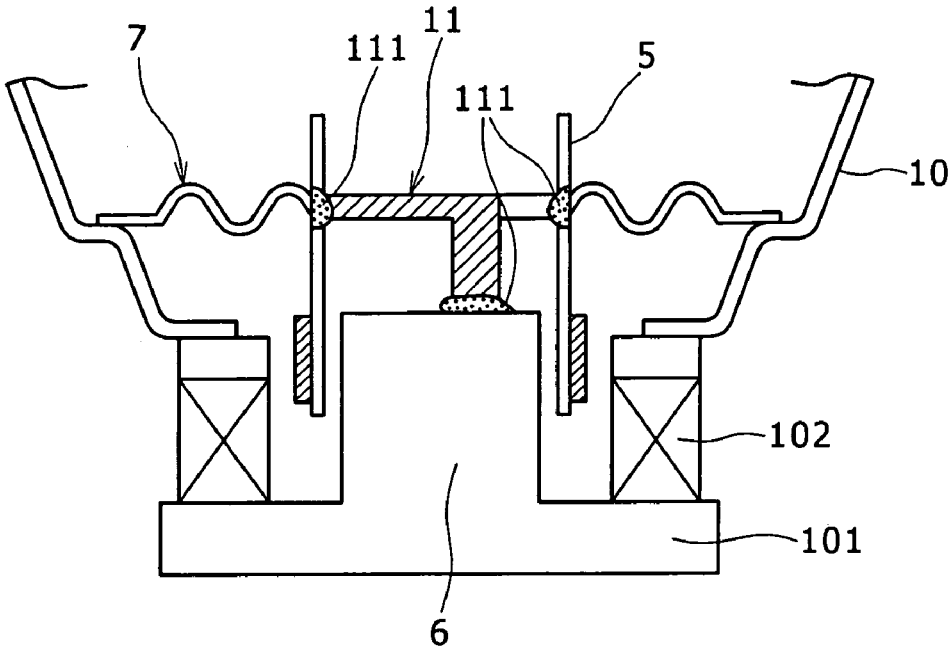
FIG. 10 shows a method of mounting an inner damper.
Figure 11:
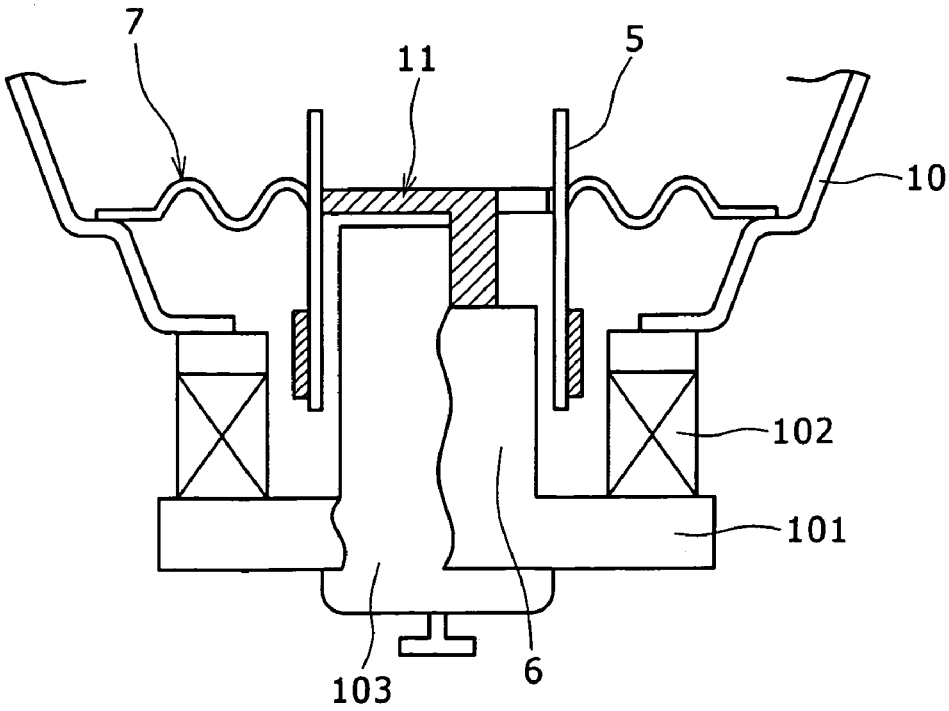
FIG. 11 shows a method of positioning an inner damper.

In FIGS. 9, 10 and 11, a method of mounting the outer damper 7 and the inner damper 11 for damping a voice coil 5 which is a vibrating portion, onto a plate 101, a magnet 102 and a frame 10 which constitute a fixed portion of a loudspeaker.

First, a voice coil gage 103 is fitted into the inner periphery of the track-shaped voice coil 5 having a minor diameter and a major diameter, of the vibrating portion, and is fitted over a pole 6 of the fixed portion.

Next, at a position where the voice coil 5 is fixed by the voice coil gage 103, as indicated by 104, a frame portion 12 of the outer damper 7 supporting the outer periphery of the voice coil 5 and the outer periphery of the voice coil 5 are adhered to each other, and a frame 10 of the fixed portion and a pair of support portions 13 and 14 for supporting the major diameter of the frame portion 12 from both sides are adhered to each other through mounting portions 15 and 16, whereby the outer damper 7 is mounted (see FIG. 2A).

FIG. 10 shows a method of mounting the inner damper 11.

After the outer damper 7 is mounted at a position shown in FIG. 9, the voice coil gage 103 is detached from the inner periphery of the voice coil 5 and the outer periphery of the pole 6. Since the positioning of the voice coil 5 has been achieved by the outer damper 7 mounted, the inner damper 11 is inserted into the inner periphery of the voice coil 5 in the positioned condition.

Subsequently, as indicated by 111, a frame portion 21 of the inner damper 11 supporting the inner periphery of the voice coil 5 and the inner periphery of the voice coil 5 are adhered to each other, and the pole 6 of the fixed portion and a pair of support portions supporting the minor diameter of the frame portion 21 are adhered to each other through mounting portions 24 and 25, whereby the inner damper 11 is mounted.

FIG. 11 shows a method of positioning the inner damper 11.

In mounting the inner damper 11 in FIG. 10, for achieving a more accurate positioning, the voice coil gate 103 is fitted into the inner periphery of the track-shaped voice coil 5 having the minor diameter and the major diameter, of the vibrating portion, from a lower portion of the plate 101, and is fitted over the outer periphery of the pole 6 of the fixed portion.

Figure 12A:
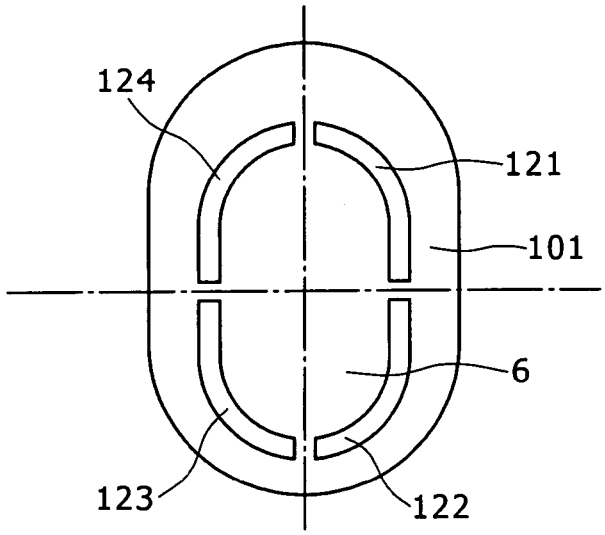
Figure 12B:
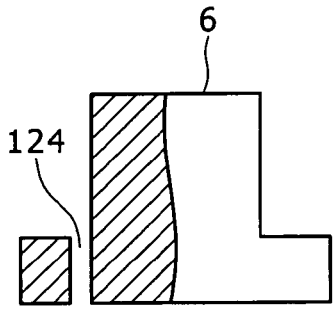
Figure 13:
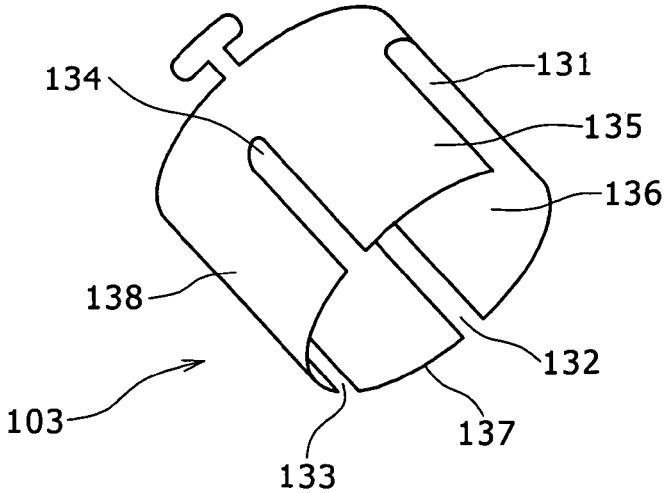
FIG. 13 sows the shape of a voice coil gage.

FIGS. 12A and 12B show insertion holes 121, 122, 123, 124 provided in a lower portion of the plate 101 so as to penetrate to the outer periphery of the pole 6, in which FIG. 12A is a bottom view, and FIG. 12B is a partly sectional view. FIG. 13 shows the shape of the voice coil gage 103. As shown in FIG. 13, the voice coil gate 103 is provided with notches 131, 132, 133, 134 in the periphery thereof, to form insertable portions 135, 136, 137, 138.

The insertable portions 135, 136, 137, 138 shown in FIG. 13 are provided at positions corresponding to, and so as to be insertable into, the insertion holes 121, 122, 123, 124 shown in FIG. 12A.

Therefore, the insertable portions 135, 136, 137, 138 of the voice coil gate 103 shown in FIG. 13 can be inserted through the insertion portions 121, 122, 123, 124 provided in the lower portion of the plate 101 shown in FIG. 12A. The voice coil gage 103 is so inserted that the notches 131, 132, 133, 134 of the voice coil gate 103 are projected at the upper end of the pole 6.

In this case, since the notches 131 and 133 are provided in the major diameter direction whereas the notches 132 and 134 are provided in the minor diameter direction, the adhering positions between the frame portion 21 of the inner damper 11 and the voice coil 5 can be aligned to the positions of the notches 131 and 133 provided in the major diameter direction and the positions of the notches 132 and 134 provided in the minor diameter direction. At this aligned position, positioning for adhesion between the mounting portions 24, 25 of the inner damper 11 and the upper end of the pole 6 can be performed.

Figure 14:
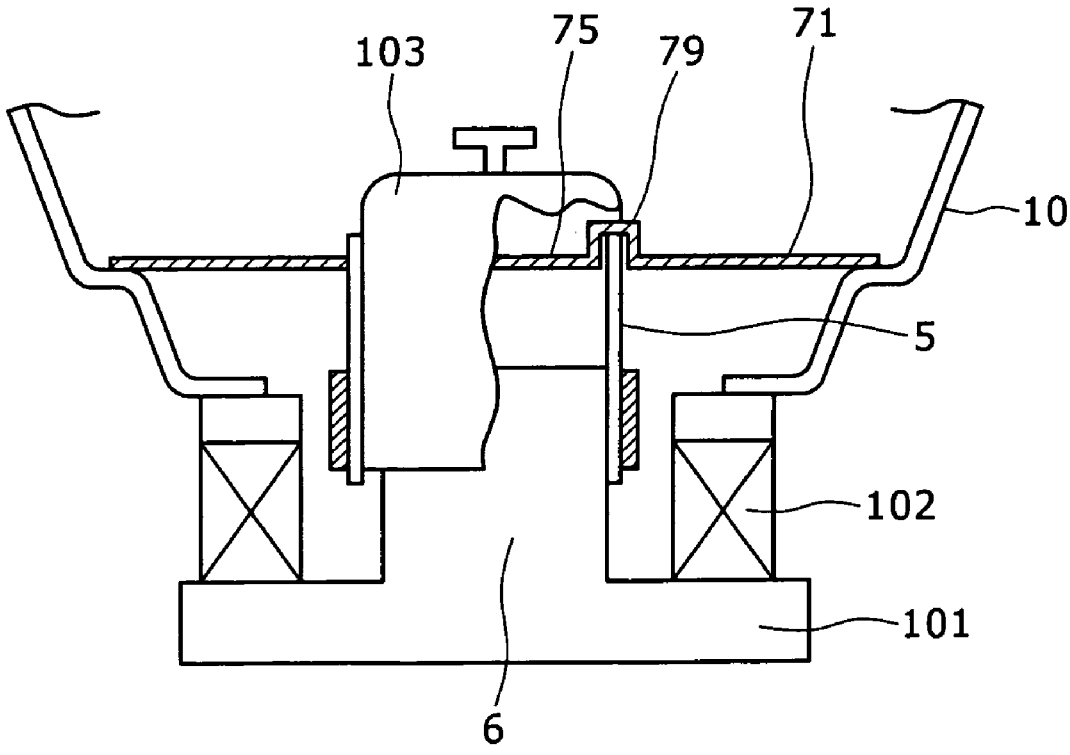
FIG. 14 shows a method of mounting an outer damper in the case where the outer damper and an inner damper are integral with each other.
Figure 15A:
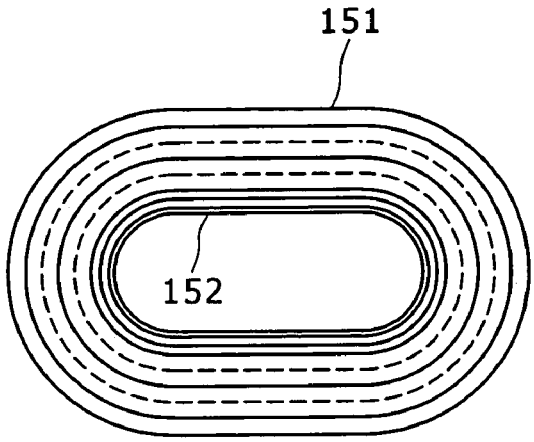
Figure 15B:
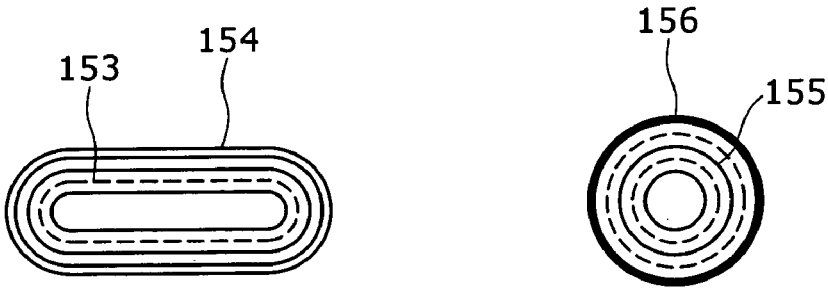
Figure 15C:
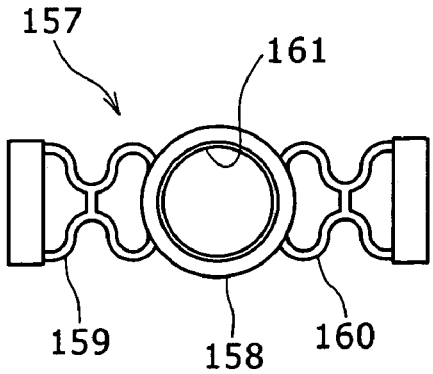

FIG. 14 shows a method of mounting an outer damper 71 and an inner damper 75 in the case where the outer damper 71 and the inner damper 75 are integral with each other as shown in FIG. 7.

First, a voice coil gage 103 is inserted into the inner periphery of a track-shaped voice coil 5 having a minor diameter and a major diameter, of a vibrating portion, and is fitted over the outer periphery of a pole 6 of a fixed portion, through the outer damper 71 and the inner damper 75 which are integral with each other.

In this case, the joint portions 91, 92 relevant to the minor diameter and the joint portion 93, 94 relevant to the major diameter, which are shown in FIG. 8, can be aligned to the positions of the notches 132 and 134 formed in the voice coil gage 103 in the minor diameter direction and the positions of the notches 131 and 133 formed in the voice coil gage 103 in the major diameter direction as shown in FIG. 13.

According to this embodiment as above, for reducing the width of the diaphragm of a loudspeaker, the shape of the voice coil is set to be a irregular shape having a longer diameter in one direction, whereby the outer periphery of the voice coil is enlarged as compared with a circular voice coil having the same width, so that the vibration characteristic at the time of reproducing a high-output signal can be made advantageous.

In this case, for reducing the width, the outer damper in the support system located on the outside of the voice coil is supported relative to the frame of the fixed portion only in the major diameter direction, and is not supported in the minor diameter direction. This makes it possible to produce a loudspeaker with a smaller width.

Besides, in this case, the inner damper is additionally provided in the inside of the voice coil. The inner damper inside the voice coil is configured to have support portions in at least one pair of symmetrical directions.

Therefore, the pair of support portions in the minor diameter direction support different positions of the pole. This ensures that, while an ordinary inner damper copes with an amplitude equivalent to one half of the minor diameter of the voice coil, it is made possible to configure an inner damper which can cope with an amplitude of nearly double the amplitude of an ordinary inner damper by the pair of support portions. Accordingly, it is possible to produce a loudspeaker having a low minimum resonance frequency $F_0$ and a wide reproduction frequency band.

In addition, since the supporting in the major diameter direction is made by the outer damper on the outside of the voice coil and the supporting in the minor diameter direction is made by the inner damper on the inside of the voice coil, the vibrating portion can be supported securely, and the voice coil can be prevented from undergoing rolling or the like due to vibration, even upon input of a high-level signal to the loudspeaker.

Besides, by use of the outer damper on the outside of the voice coil and the inner damper on the inside of the voice coil, it is possible to fix the voice coil at two positions. As a result, the voice coil can be prevented from being deformed at the time of vibration, and frictional contact between the voice coil and a magnetic circuit can be prevented from occurring.

Furthermore, examples of the material for the dampers include plastics, phenol resin-impregnated cotton fabric, phenol resin-impregnated polyesters, phenol-impregnated amide fibers, metals, and bakelite. In addition, the outer damper on the outside of the voice coil and the inner damper on the inside of the voice coil may be formed of different materials.

The present invention naturally is not limited to the above-described embodiments, and modifications can be appropriately made within the scope of the claims of the invention.

What is claimed is:

1. A loudspeaker damper comprising:

an outer damper; and an inner damper, wherein the outer damper and the inner damper are configured to damp a vibrating portion relative to a fixed portion of a loudspeaker, wherein the outer damper supports an outer periphery of a voice coil of the vibrating portion relative to the fixed portion, the outer damper including support portions configured to support the outer periphery of the voice coil from only two opposing sides of the voice coil, and wherein the inner damper supports an inner periphery of the voice coil relative to the fixed portion.

2. The loudspeaker damper according to the claim 1, wherein the voice coil has an oblong shape having a minor diameter and a major diameter, wherein the outer damper includes a frame portion configured to support the outer periphery of the voice coil, a pair of support portions configured to support the major diameter of the frame portion from only opposing ends of the major diameter of the frame portion, and mounting portions configured to mount both the pair of support portions of the outer damper onto a frame of the fixed portion.

3. The loudspeaker damper according to the claim 2, wherein the mounting portions are connected to outer sides of the support portions supporting the opposing sides of the major diameter of the frame portion.

4. The loudspeaker damper according to the claim 1, wherein the voice coil has an oblong shape having a minor diameter and a major diameter, wherein the inner damper includes a frame portion configured to support the inner periphery of the voice coil, a pair of support portions configured to support the minor diameter of the frame portion of the inner damper from opposing ends of the minor diameter of the frame portion of the inner damper, and mounting portions configured to mount the pair of support portions of the inner damper onto a pole of the fixed portion.

5. The loudspeaker damper according to the claim 4, wherein the pair of support portions of the inner damper are provided in a plurality of pairs.

6. The loudspeaker damper according to the claim 4, wherein the pair of support portions of the inner damper are configured to support the minor diameter of the frame portion substantially from only opposing sides of the minor diameter of the frame portion of the inner damper.

7. The loudspeaker damper according to the claim 1, wherein the outer damper and the inner damper are configured to be integral with each other.

8. A method of mounting a loudspeaker damper onto a loudspeaker, the loudspeaker damper including an outer damper and an inner damper for damping a vibrating portion relative to a fixed portion of the loudspeaker, wherein the method comprising the steps of:

determining a positioning such that the outer damper and the inner damper are fixed by fitting a jig in the inner periphery of an oblong-shaped voice coil of the vibrating portion and over the outer periphery of a pole of the fixed portion, the oblong-shaped voice coil having a minor diameter and a major diameter;

mounting the outer damper by adhering the outer periphery of the voice coil to a frame portion configured to support the outer periphery of the voice coil, and by adhering a frame of the fixed portion and a pair of support portions configured to support the major diameter of the frame portion from both ends of the major diameter of the frame portion through mounting portions; and mounting the inner damper by adhering the inner periphery of the voice coil to a frame portion to support the inner periphery of the voice coil, and by adhering the pole of the fixed portion and a pair of support portions configured to support the minor diameter of the frame portion from both ends of the minor diameter of the frame portion through mounting portions.

* * * * *